US006102615A

United States Patent [19]

Wilson, Sr.

[11] Patent Number: 6,102,615

[45] Date of Patent: Aug. 15, 2000

[54] PAVEMENT AND TENNIS COURT COATING MACHINE

[76] Inventor: Jack H. Wilson, Sr., 4654 Hickory Ridge Rd., Jackson, Miss. 39211

[21] Appl. No.: 08/971,561

[22] Filed: Nov. 17, 1997

[51] Int. Cl.[7] ..... E01C 19/12

[52] U.S. Cl. ..... 404/111; 118/108

[58] Field of Search ..... 15/98, 401, 320; 118/108, 207, 100, 256, 264, 407; 404/105, 110, 111, 118

[56] References Cited

U.S. PATENT DOCUMENTS

| | | | |
|---|---|---|---|
| 2,317,843 | 4/1943 | Backlund . | |
| 2,531,370 | 11/1950 | Thompson . | |
| 2,989,769 | 6/1961 | Houser . | |
| 3,277,511 | 10/1966 | Little et al. . | |
| 3,305,887 | 2/1967 | Turner . | |
| 3,345,671 | 10/1967 | Wilson et al. . | |
| 3,571,841 | 3/1971 | Crouser . | |
| 3,841,779 | 10/1974 | Ray . | |
| 3,989,403 | 11/1976 | Verive . | |
| 4,191,590 | 3/1980 | Sundheim . | |
| 4,575,279 | 3/1986 | Mateja . | |
| 4,732,109 | 3/1988 | Selby . | |
| 4,767,234 | 8/1988 | Rizzo | 404/111 |
| 4,789,265 | 12/1988 | Wilson et al. . | |
| 4,906,126 | 3/1990 | Wilson et al. . | |
| 4,917,533 | 4/1990 | Wilson . | |
| 4,959,884 | 10/1990 | Ingermann et al. . | |
| 5,054,159 | 10/1991 | Richardson . | |
| 5,239,720 | 8/1993 | Wood et al. . | |
| 5,287,583 | 2/1994 | Lilja . | |
| 5,301,387 | 4/1994 | Thomas et al. . | |
| 5,302,051 | 4/1994 | Wilson, Sr. | 404/84.1 |
| 5,362,178 | 11/1994 | Schantz . | |
| 5,366,309 | 11/1994 | Springhall . | |
| 5,735,952 | 4/1998 | Wilson, Sr. . | |
| 5,807,022 | 9/1998 | McCleary | 404/97 |

OTHER PUBLICATIONS

Squeegeeco, Inc. brochure entitled "Super Squeege".

*Primary Examiner*—James A. Lisehora
*Attorney, Agent, or Firm*—Merek & Voorhees

[57] ABSTRACT

An apparatus for applying a coating to a surface. Preferably, the coating is a polymer fortified cement applied to protect various surfaces. The apparatus includes a support frame and a tank for storing coating materials. The tank is operably associated with the support frame. The tank includes a dispensing conduit for dispensing coating materials onto a surface. The apparatus further includes a coating material applicator operably associated with the support frame for applying the coating material to a surface. In other words, the coating applicator is directly or indirectly connected (i.e. operably associated) to the support frame to apply the coating material to a surface. The coating material applicator includes a first blade, a finishing blade and at least one end blade. The end blade is configured such that the portion directly adjacent the surface to be coated is the thinnest portion of the end blade. Such a configuration eliminates the wide tracks and ridges left by other applicators when applying various coatings such as polymer fortified cement. The end blade is readily and easily adjusted so that its position relative to the surface to be coated can be varied. This feature enables the operator to maintain the desired downward pressure on the surface to be coated.

4 Claims, 4 Drawing Sheets

PAVEMENT AND TENNIS COURT COATING MACHINE

FIELD OF THE INVENTION

The present invention relates generally to devices for applying a coating to a surface. In particular, the invention relates to devices for applying a protective coating to pavement surfaces (e.g. parking lots and driveways) and hard court surfaces (e.g. tennis courts and racquet ball courts).

BACKGROUND OF THE INVENTION

A very large industry has existed for many years in the U.S. referred to as "The Asphalt Sealing Industry". This industry's primary function is to apply a protective sealant such as a coal tar sealant to new and old asphalt surfaces to retard oxidation and further to protect the asphalt surface from the damaging effects of such fluids as water and those emitted from an automobile. Oxidation causes severe deterioration in asphalt surfaces, if the surface is left unprotected. In those parts of the U.S. experiencing ice and snow, unprotected asphalt can and often will be severely damaged by the melting snow and ice. Further damage is caused to unprotected asphalt by substances such as salt employed to accelerate melting of snow and ice. Automotive fluids such as brake fluid, oil, gasoline, diesel fuel etc. leaking from automobiles also have a significant adverse effect on the longevity of unprotected asphalt surfaces. Automotive fluids of the type identified above along with the oxidation process cause unprotected asphalt to ravel and pot holes to form. The Asphalt sealing industry emerged in large part to overcome the undesirable deterioration of unprotected asphalt. Sealant contractors in this industry have for many years contracted with various individuals and businesses to apply coal tar sealants to asphalt surfaces to prevent deterioration. Coal tar sealants are generally effective but there are a number of disadvantages attendant their application and use. For example, the application of a coal tar sealant by spray equipment allows particles to become airborne and thereby soiling workers, buildings and numerous other animate and inanimate objects. Coal tar sealants also have a significant tracking problem. This is due in large part to the prolonged curing period attendant spray application of the coal tar sealant. The tracking problem is particularly troublesome for restaurant and/or fast food proprietors because the sealant is tracked into the establishment. Another disadvantage attendant coal tar sealants is the very strong odor. This undesirable odor compounds the tracking problem in that not only is the establishment soiled by the material but the odor as well.

A significant "do-it-yourself" market has not evolved due to the skill required in applying sealants and in particular sand filled sealants. Inexpensive coal tar sealants sold at stores generally do not include sand. However, such sealants do not nearly have the longevity of sand filled sealants.

In my U.S. patent application Ser. No. 08/593,289, the entire contents of which is incorporated by reference herein, I disclose a novel and unobvious device for applying protective coatings to various surfaces which is a significant advancement over previously known devices. Due to the simplicity of the operation of this device and the cleanliness of the procedure, small businessmen can apply the material at a significantly reduced cost to that of an outside contractor while creating a beautiful, protected parking area that will last for years. My previous device eliminates various problems attendant spray application of coal tar sealants. The present invention is an improvement over my prior device. Specifically, the end blades have been redesigned to include an adjustable rubber strip. The design of the end blades allows even the unskilled worker to readily adjust the position of the blade relative to the surface to be coated. In addition, the end blades have been designed to include a tapered rubber strip. The taper is such that the thinnest portion of the rubber strip is positioned directly adjacent the surface to be coated. This design eliminates wide track marks and ridges left by wide (i.e. untapered) end blades when applying various coatings.

OBJECTS AND SUMMARY OF THE INVENTION

An object of the present invention is to provide a device which avoids the significant disadvantages attendant conventional spray applicators used to apply protective coatings such as coal tar sealants to an asphalt surface.

Another object of the present invention is to provide a device which reduces and/or eliminates the "tracking" problem encountered when using conventional applicators for applying coal tar sealants.

A further object of the present invention is to provide a device for applying coal tar sealants and other protective coatings with end blades, the position of which can be easily and readily adjusted.

Yet another object of the present invention is to provide a device for applying coal tar sealants and other protective coatings with end blades configured in such a manner as to eliminate wide tracks and ridges left by other applicators when applying various coatings to a surface.

These and other objects and advantages of the present invention will be readily understood by those skilled in the art after a review of the detailed description of the preferred form of the invention and the accompanying drawings. These objects are not exhaustive and are not to be construed as limiting the scope of the claimed invention.

In summary, the present invention is directed to an apparatus for applying a coating to a surface. Preferably, the coating is a polymer fortified cement such as that sold under the name ENVIRO-KRETE applied to protect various surfaces as revealed for the first time in my pending U.S. patent application filed on Nov. 3, 1997 and entitled METHOD FOR SEALING AND MARKING PAVEMENT WITH RECOGNIZABLE INDICIA the entire contents of which is incorporated by reference herein. However, it must be understood that the present invention is not limited to a device which only applies this type of coating. The apparatus includes a support fame and a tank for storing coating materials. The tank is operably associated with the support frame. The tank includes a dispensing conduit for dispensing coating materials onto a surface. The apparatus further includes a coating material applicator operably associated with the support frame for applying the coating material to a surface. In other words, the coating applicator is directly or indirectly connected (i.e. operably associated) to the support frame to apply the coating material to a surface. The coating material applicator includes a first blade, a finishing blade, a brush and at least one end blade. The end blade is configured such that the portion directly adjacent the surface to be coated is the thinnest portion of the end blade. Such a configuration eliminates the wide tracks and ridges left by other applicators when applying various coatings. The end blade is readily and easily adjusted so that its position relative to the surface to be coated can be varied. This feature enables the operator to maintain the desired downward pressure on the surface to be coated.

The above summary of the invention describes a preferred form of the invention and is not in any way to be construed as limiting the claimed invention to the preferred form.

DETAILED DESCRIPTION OF THE DRAWINGS

DETAILED DESCRIPTION OF THE INVENTION

The preferred embodiment of the present invention will now be described in connection with FIGS. 1–6.

FIGS. 1–6

Figure 1:
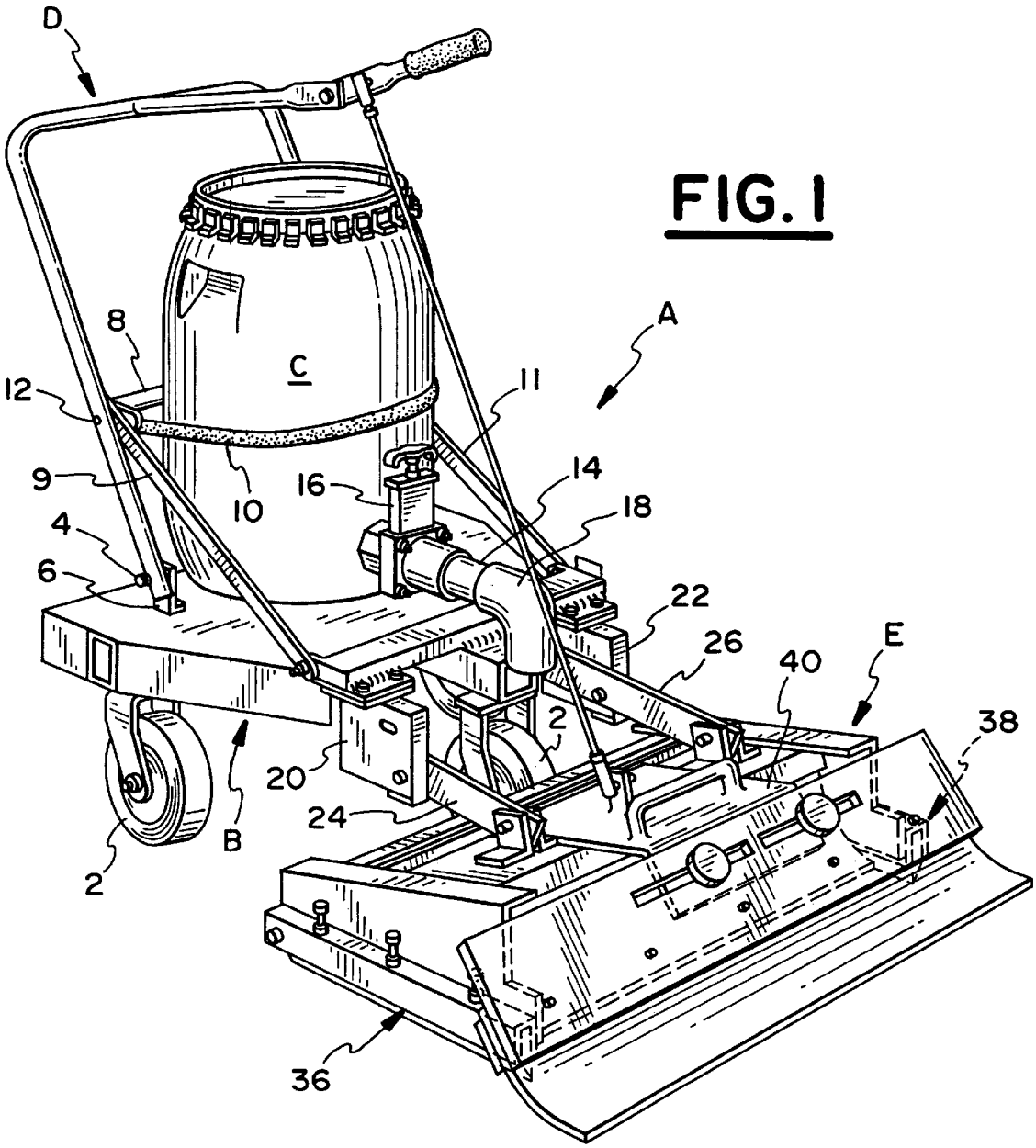
FIG. 1 is a perspective view of the preferred embodiment of the present invention.
Figure 2:
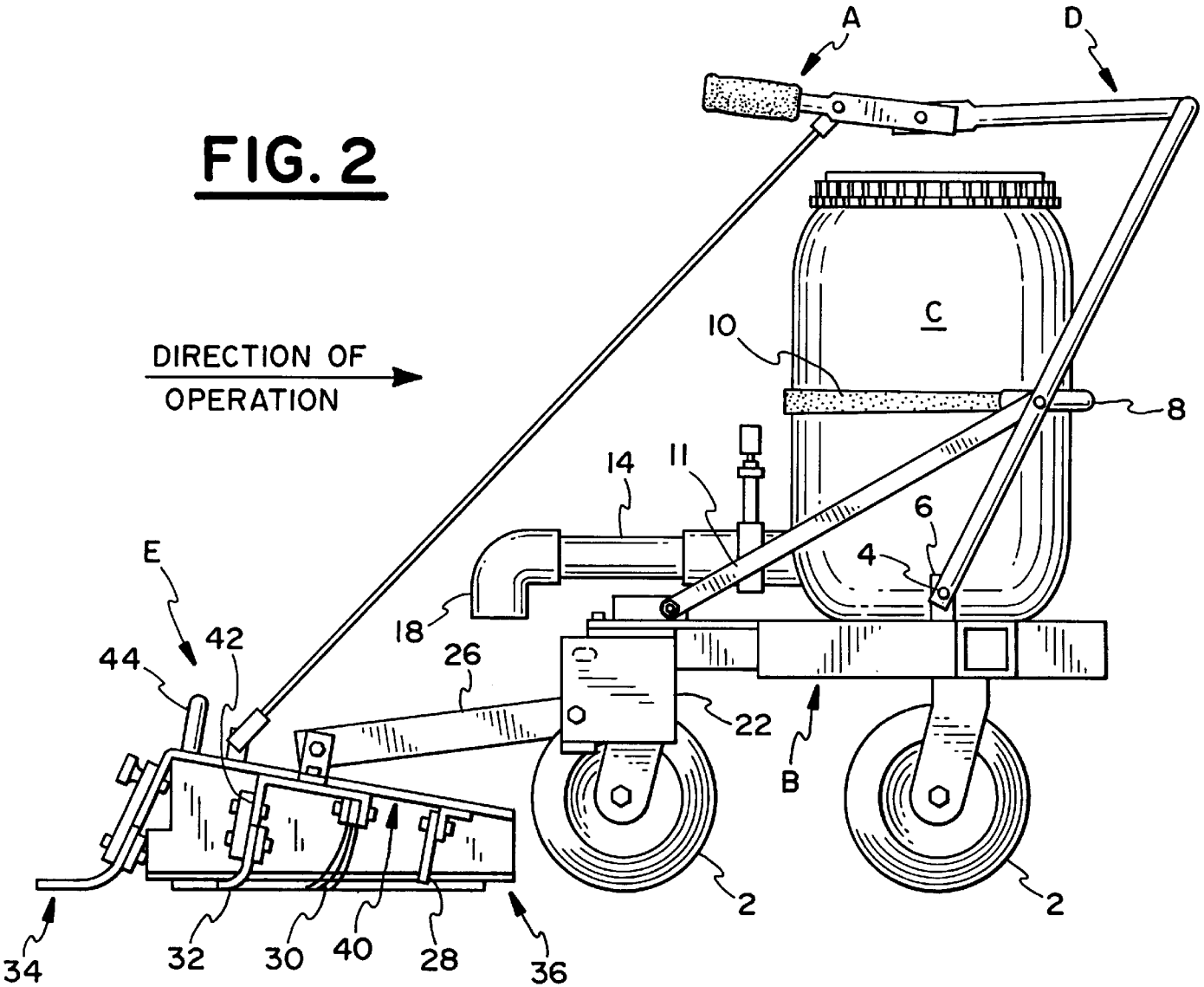
FIG. 2 is a side elevational view of the preferred embodiment of the invention with one end blade removed.

Referring to FIGS. 1 and 2, a coating machine A includes a support frame or base B, a coating container C, a towing frame D, and a coating applicator E. The base B is supported by three wheels or casters 2. The towing frame D is substantially U-shaped and connected to the base B by bolts 4 and L-shaped brackets 6. It will be readily appreciated that numerous other arrangements may be employed to secure the towing frame D to the base B. A cross-bar 8 and braces 9 and 11 provide the towing frame D with added stability.

The coating container C is mounted on the base B and secured thereto by a support strap 10. The support strap 10 is connected at each end to the towing frame D via conventional fasteners 12. A discharge tube or conduit 14 extends from a lower portion of the coating container C. A valve 16 located on the tube 14 regulates the flow of material out of the coating container C. A directional elbow 18 is joined to discharge tube 14 to direct the flow of material to the surface to be sealed. It will be readily appreciated that numerous other arrangements may be utilized to direct and regulate the flow of the coating material.

A pair of brackets 20 and 22 extend outwardly from the base B. The brackets 20 and 22 are connected to support arms 24 and 26, respectively, by conventional fasteners. The arms 24 and 26 support the coating applicator E via L-shaped brackets and conventional fasteners. Once again, it will be readily appreciated by those of ordinary skill in the art that numerous other arrangements may be employed to connect the coating applicator E to the base B.

As shown in FIG. 2, the coating applicator E includes a first squeegee 28 and a first brush 30. The coating applicator E is also provided with a second squeegee 32 and a third squeegee 34. Referring to FIGS. 1 to 4, the coating applicator E further includes first and second end blades 36 and 38. The first squeegee 28 is adjustably mounted to the squeegee support frame 40.

Figure 4:
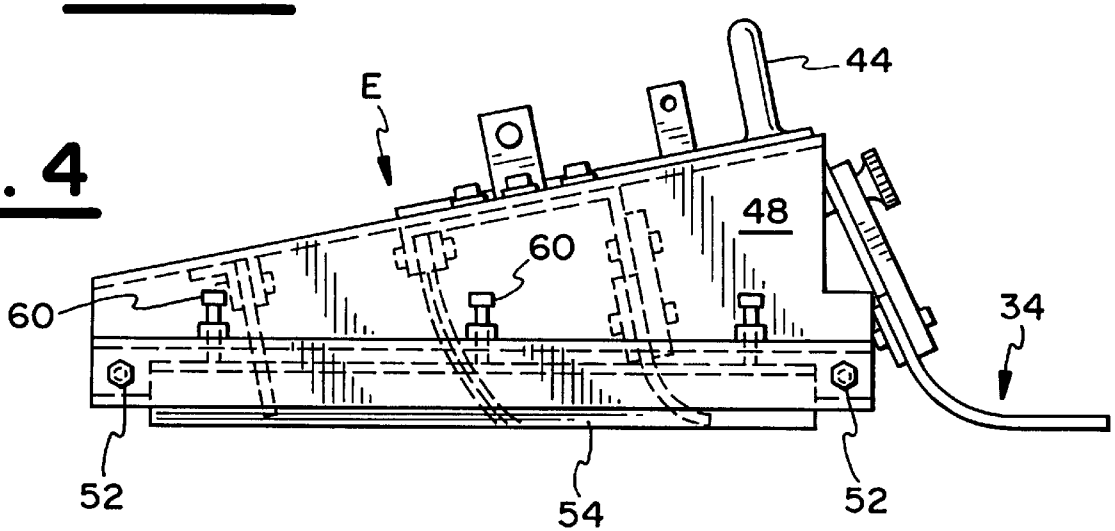
FIG. 4 is a side elevational view of the coating applicator.
Figure 5:
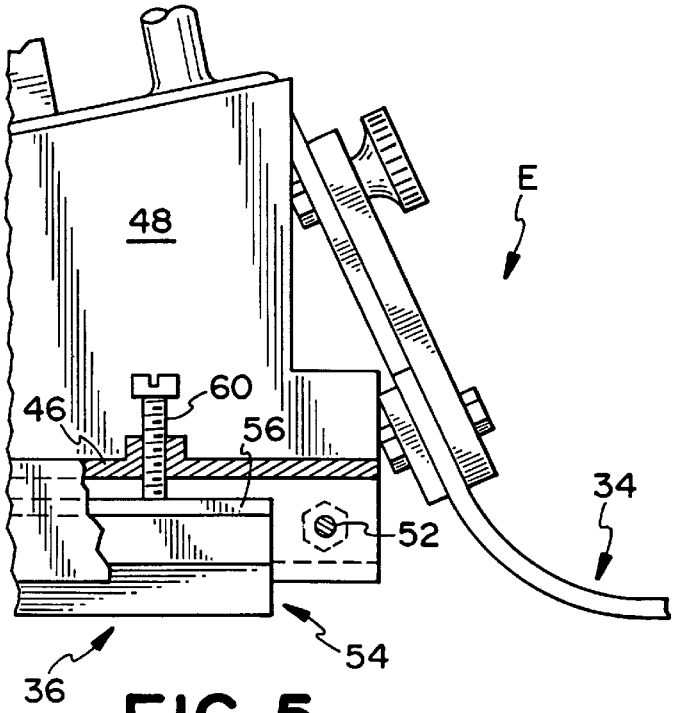
FIG. 5 is an enlarged fragmentary side elevational view of the coating applicator.

As seen in FIGS. 2 and 4, squeegee 28 is the first element to contact the freshly applied coating material and forces the coating material against the surface. The thickness of the material is determined by the relative position of the squeegee 28 to the surface to be coated. The squeegee 28 is preferably 4 inches wide and formed from 60 durometer rubber. Brush 30 follows squeegee 28 in the application process to remove any excess coating material not designed to fill voids from undulations in the surface without removing the desired thickness of the material. Brush 30 is preferably a 4 inch polypropylene brush.

Referring to FIGS. 2 and 4, the second squeegee 32 follows the brush 30 in the application process. Because the second squeegee 32 is weighted by weighted holder 42, the necessary downward pressure is maintained to prevent brush 30 from lifting the end blades 36 and 38 out of contact with the surface to be coated. Squeegee 32 is formed from 50 durometer rubber. Preferably, the weighted holder 42 is 4 inches wide and a ½ inch thick. It preferably weighs 0.56 lbs. per linear inch. Squeegee 34 is the trim squeegee and is the final element to act on the coating material. This squeegee provides the desired finish to the coating surface. It is preferably very soft and designed to eliminate any marks left by the blades or the brush and is placed at an angle that will not remove material. Preferably, the final trim squeegee lays flat two inches on the coated surface to provide a wiping action.

Figure 3:
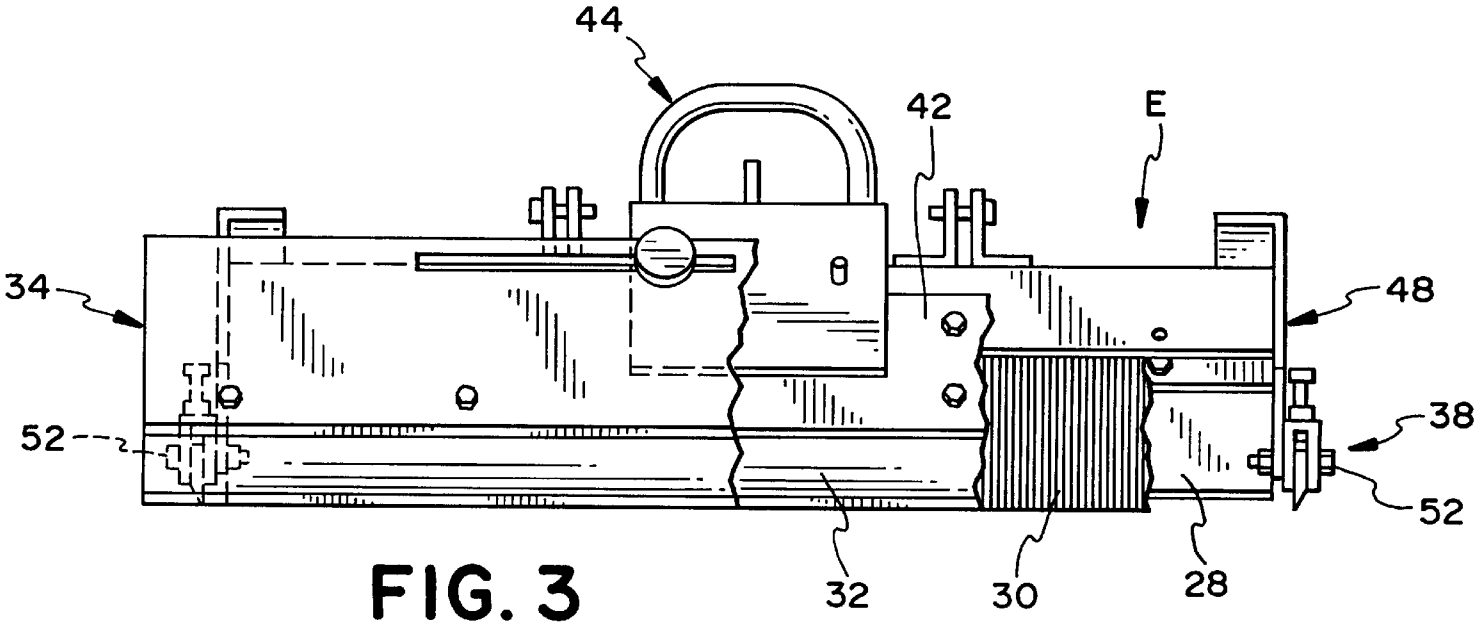
FIG. 3 is a fragmentary front elevational view of the coating applicator.

The first three elements 28, 30 and 32 are preferably 24 to 30 inches in length. It will be readily appreciated that the length of these elements may be varied as needs dictate. Preferably, trim squeegee 34 is about 6 inches longer than the first three elements 28, 30 and 32, as seen in FIGS. 1 and 3. Trim squeegee 34 is so sized to provide three inches of overlap on each side of elements 28, 30 and 32 to remove the traces of the end blades 36 and 38 in the coating material.

The coating applicator E is provided with a handle 44, as seen in FIGS. 1 to 4. The handle 44 permits an individual to easily transport the coating applicator E, once it is removed from the coating machine A.

Figure 6:
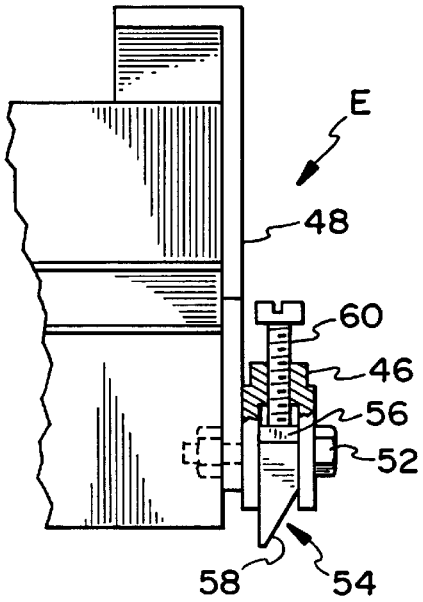
FIG. 6 is an enlarged fragmentary side elevational view of the coating applicator.

The end blades 36 and 38 are of identical construction and, therefore, only one will be described in detail hereinafter. The end blade 36 includes a substantially u-shaped channel 46 which is secured to and extends along the sidewall 48 of the squeegee support frame 40, as seen in FIGS. 3 to 6. Referring to FIG. 4, fasteners 50 and 52 pass through the channel 46 and the sidewall 48 to secure the end blade 36 thereto. Fasteners 50 and 52 also hold rubber strip 54 and the metallic protective strip 56 in channel 46. As seen in FIGS. 3 and 6, the rubber strip 54 has a tapered portion 58 which is positioned directly above the surface of the pavement to be coated. Tapered portion 58 is an important aspect of the present invention because it enables the coating machine A to eliminate wide tracks and ridges left by other coating machines if used to apply various coatings such as a polymer fortified cement to a surface.

Three adjustment screws 60 are provided to readily adjust the position of the rubber strip 54. The metallic protective strip 56 extends along the length of the rubber strip 54 and prevents the adjustment screws 60 from damaging the top portion of the rubber strip 54, as seen in FIG. 4. The protective strip 56 further ensures that the rubber strip 54 is maintained at the same position relative to the surface to be coated over its entire length.

Figure 7:
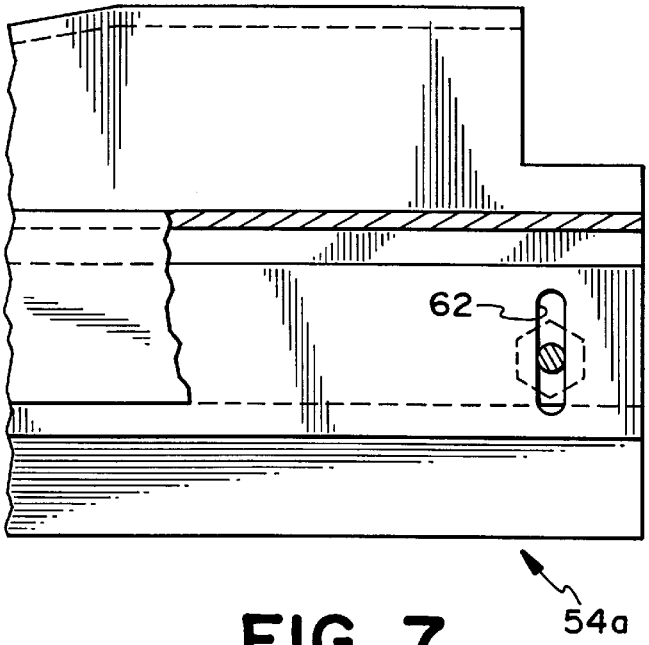
FIG. 7 is an enlarged fragmentary front elevational view of the end blades illustrating an alternative adjustment means.
Figure 8:
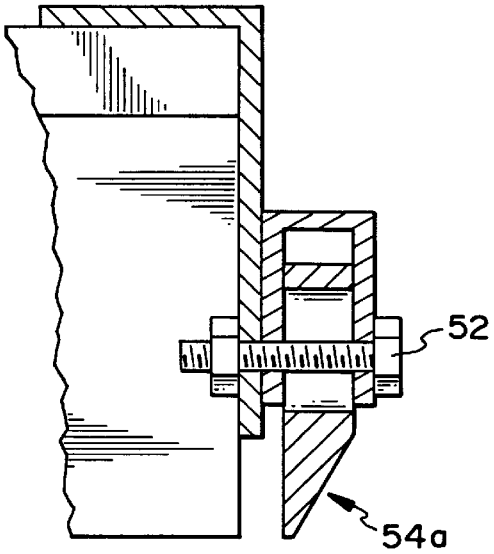
FIG. 8 is an enlarged fragmentary side elevational view of the alternative adjustment means depicted in FIG. 7.

It should be understood that the adjustment screws 60 can be omitted and adjustment obtained by forming elongated slots 62 adjacent the ends of the rubber strip 54*a*, as shown in FIGS. 7 and 8. In this arrangement, fasteners 50*a* and 52*a* pass through the elongated slots. The elongated slots allow an individual to move the rubber strip 54*a* in the vertical direction to compensate for ware.

While this invention has been described as having a preferred design, it understood that it is capable of further modifications, uses and/or adaptions of the invention following in general the principle of the invention and including such departures from the present disclosure as come within the known or customary practice in the art to which the invention pertains and pertains and as maybe applied to the central features hereinbefore set forth, and fall within the scope of the invention and the limits of the appended claims.

What is claimed is:

1. An apparatus for applying along a direction of travel a coating to a surface, said apparatus comprising:

a) a support frame;

b) a tank for containing coating material operably associated with said support frame, said tank having a dispensing conduit for dispensing coating material onto a surface;

c) a coating material applicator operably associated with said support frame for applying coating material to a surface, said coating material applicator including a first blade, a finishing blade and at least one end blade, said at least one end blade includes first and second portions, said at least one end blade positioned substantially parallel with a direction of travel of said apparatus;

d) adjusting means for adjusting the operating position of said second portion of said at least one end blade relative to said first portion;

e) said adjusting means includes a plurality of screws;

f) said second portion of said at least one end blade is a rubber strip;

g) said rubber strip includes a top and a bottom, said bottom is tapered;

h) said at least one end blade includes a protective strip positioned adjacent said top of said rubber strip;

i) a plurality of wheels operably associated with said support frame; and j) said adjustment means includes at least one elongated slot formed in said second portion.

2. An apparatus for applying in a direction of travel a coating to a surface, said apparatus comprising:

a) a support frame;

b) a tank for containing coating material operably associated with said support frame, said tank having a dispensing conduit for dispensing coating material onto a surface;

c) a coating material applicator operably associated with said support frame for applying coating material to a surface, said coating material applicator including a first blade, a finishing blade and at least one end blade, said at least one end blade includes first and second portions;

d) said at least one end blade includes a substantially u-shaped retaining bracket and a rubber strip, said at least one end blade further includes adjustment means for adjusting an operating position of said rubber strip relative to the surface to be coated, said at least one end blade positioned substantially parallel with a direction of travel of said apparatus;

e) said rubber strip includes a top and a bottom, said bottom of said rubber strip is tapered;

f) said at least one end blade includes a protective strip positioned adjacent said top of said rubber strip;

g) said adjustment means includes a plurality of screws; and h) at least one of said plurality of screws abuts said protective strip.

3. An apparatus as set forth in claim 2, further including:

a) a plurality of wheels operably associated with said support frame.

4. An apparatus as set forth in claim 3, further including:

a) a handle for facilitating manual propulsion of said support frame.

* * * * *